US006663200B1

(12) United States Patent
James

(10) Patent No.: US 6,663,200 B1
(45) **Date of Patent: *Dec. 16, 2003**

(54) LECTERN

(76) Inventor: Dan James, 1791Kirkham Way, Salt Lake City, UT (US) 84119

( * ) Notice: Subject to any disclaimer, the term of this patent is extended or adjusted under 35 U.S.C. 154(b) by 0 days.

This patent is subject to a terminal disclaimer.

(21) Appl. No.: 09/618,491

(22) Filed: Jul. 18, 2000

Related U.S. Application Data

(63) Continuation-in-part of application No. 09/023,190, filed on Feb. 13, 1998, now Pat. No. 6,092,885.

(51) Int. Cl.[7] ..... A47B 19/00

(52) U.S. Cl. ..... 312/233; 312/140.2; 312/249.8; 312/33; 40/611

(58) Field of Search ..... 312/33, 233, 234, 312/230, 231, 232, 204, 249.8, 140.1, 140.2; 108/27; D6/419, 425, 426; 40/611, 320

(56) References Cited

U.S. PATENT DOCUMENTS

| | | | | | |
|---|---|---|---|---|---|
| D178,318 | S | * | 7/1956 | Walker | D6/419 X |
| D179,235 | S | * | 11/1956 | Anderson | D6/419 |
| 3,697,363 | A | * | 10/1972 | Martinez | 312/204 |
| D245,381 | S | * | 8/1977 | Lilley | D6/419 |
| 4,052,561 | A | | 10/1977 | Molay | |
| 4,158,277 | A | * | 6/1979 | Krempp et al. | 312/204 X |
| D254,998 | S | * | 5/1980 | Espeseth | D6/419 |
| 4,258,833 | A | | 3/1981 | Simms | |
| 4,294,497 | A | | 10/1981 | Daniel | |
| 4,431,080 | A | | 2/1984 | Everhart | |
| 4,618,120 | A | | 10/1986 | Wattles | |
| 4,623,276 | A | | 11/1986 | Kinneir | |
| D308,522 | S | * | 6/1990 | Swinburne | D6/419 X |
| 5,044,595 | A | | 9/1991 | Carr et al. | |
| 5,087,010 | A | | 2/1992 | Walters | |
| 5,224,768 | A | | 7/1993 | Vautier | |
| D339,933 | S | * | 10/1993 | Fafoutis | D6/419 |
| 5,738,423 | A | | 4/1998 | Alfaro | |
| 5,882,095 | A | * | 3/1999 | Green | 312/33 |
| D424,321 | S | * | 5/2000 | Sebby | D6/419 |

FOREIGN PATENT DOCUMENTS

| | | | | |
|---|---|---|---|---|
| FR | 2562402 | * | 10/1985 | 312/233 X |
| GB | 2310676 | * | 9/1997 | |
| JP | 5146317 | * | 6/1993 | |

* cited by examiner

*Primary Examiner*—Lanna Mai
*Assistant Examiner*—Hanh V. Tran
(74) *Attorney, Agent, or Firm*—Thorpe North & Western LLP

(57) ABSTRACT

A floor standing lectern includes a single, unitary, continuous shell formed of a plastic material and having an integral and continuous exterior wall comprised of top, front, side, rear and bottom walls which collectively enclose a hollow interior cavity. The top wall has a support surface to support a lecturer's notes, and a perimeter which substantially comprises a rounded edge joining the top wall to the side, front and rear walls. The front wall faces an audience, and has a height sized to extend substantially from the floor to at least the top wall. The front wall has a perimeter which substantially comprises a rounded edge joining the front wall to the opposite side walls.

19 Claims, 3 Drawing Sheets

LECTERN

This application is a continuation-in-part of U.S. application Ser. No. 09/023,190, filed Feb. 13, 1998 now U.S. Pat. No. 6,092,885.

BACKGROUND OF THE INVENTION

1. The Field of the Invention

The present invention relates generally to a lectern. More particularly, the present invention relates to a light-weight, durable, floor standing lectern formed of a single continuous shell.

2. The Background Art

Lecterns are typically used by speakers or lecturers in speaking or lecturing to an audience. A lecturer may utilize the lectern to hold notes, or other materials. In addition, the lecturer may utilize the lectern to hold onto, or lean against, and as a shield or partition between the lecturer and the audience. Lecterns tend to direct the attention of the audience to a center or focal point. In addition, lecterns tend to provide a sense of authority and order.

Such lecterns may be used in various situations, such as teaching, making presentations, giving speeches, etc. In addition, such lecterns may be used in various different settings or environments, such as permanent, dedicated facilities, including lecture halls, classrooms, chapels, etc., or temporary, multi-purpose facilities, such as convention centers, stages, auditoriums, gymnasiums, etc.

Typically, lecterns utilized in dedicated facilities are formal lecterns typically formed as a fixture, or extension, of the facility itself. For example, such formal lecterns are typically formed of relatively heavy materials, such as wood, to match the decor of the facility, and are relatively large.

Unfortunately, similar types of lecterns may be used in temporary facilities as well. Thus, large, heavy lecterns frequently are moved about as required. For example, such lecterns may be moved between storage and conference rooms, or between conference rooms, as required. As another example, such lecterns may be moved on and off stage to convert the stage of an auditorium from a theater to a lecture hall, and vis versa. Thus, lecterns intended for temporary or multi-purpose facilities are often constructed similarly to their more formal counterparts, i.e. as large wooden structures, with their mobility seemingly included as an afterthought.

One disadvantage of such lecterns is their weight and size make them difficult to transport. In addition to merely moving the lectern about, it is also often necessary to hoist the lectern to an elevated stage or platform. Another disadvantage of such lecterns is their lack of durability when transported. The wood material of the lecterns is easily damaged, scratches, and dinged, giving the lectern an old, abused appearance, less suitable for making positive impressions. Another disadvantage with such lecterns is their method of construction or structure. In addition to the expense of being constructed by skilled craftsmen, the multi-component structure becomes weakened by constant movement.

Other types of lecterns have been developed which are more transportable or are designed for traveling. Such lecterns are often foldable or collapsible. One disadvantage with these traveling-types of lecterns is their informal appearance which is usually less aesthetically pleasing. Another disadvantage with such traveling lecterns is their foldable parts tend to make them less stable. Many such traveling lecterns are also designed to be used in conjunction with a table, such that the lectern is placed on top of the table to achieve a usable height. One disadvantage with such table-top lecterns is their informal appearance. Another disadvantage is they are unsuitable for use on stages, etc.

SUMMARY OF THE INVENTION

It has been recognized that it would be advantageous to develop a lectern which is presentable and aesthetically pleasing, while being easily movable and more durable. In addition, it has been recognized that it would be advantageous to develop a lectern which is less expensive to produce, and more light-weight.

The invention provides a floor standing lectern with a single, unitary shell formed by an integral and continuous exterior wall. The wall includes top, front, side, rear and bottom walls which collectively enclose a hollow interior cavity. The top wall has a support surface to support a lecturer's notes, and a perimeter which substantially comprises a rounded edge joining the top wall to the side, front and rear walls. The front wall faces an audience, and has a height sized to extend substantially from the floor to at least the top wall. In addition, the front wall has a perimeter which substantially comprises a rounded edge joining the front wall to the opposite side walls. The side and rear walls have a height sized to extend substantially from the floor to at least the top wall.

In accordance with one aspect of the present invention, substantially all of the exterior wall has a continuous thickness. Preferably, the exterior wall has a thickness between approximately ⅛ inch to ⅜ inch. Most preferably, the exterior wall has a thickness of approximately ¼ inch.

In accordance with another aspect of the present invention, the lectern includes a recess formed in the front wall, and a decorative insert disposed within the recess. An opening may be formed through the front wall at the recess, and covered by the decorative insert, to reduce weight of the lectern.

In accordance with another aspect of the present invention, a front shield may be formed by the front wall extending above the top wall to block visual inspection of the lecturer's notes by the audience. Similarly, opposite side shields may be formed by the side walls extending above the top wall.

In accordance with another aspect of the present invention, opposite left and right grips may be formed at left and right sides by the top wall and the opposite side walls to be griped by a lecturer while lecturing.

In accordance with another aspect of the present invention, a rib may be integrally formed in the top wall to maintain the top wall in a flat configuration, and to form an indentation to hold a writing instrument or pointer.

In accordance with another aspect of the present invention, the walls may be oriented such that a front of the lectern is wider than a back of the lectern to produce a parting line along the side walls nearer the front wall.

In accordance with another aspect of the present invention, a recess may be formed in the rear wall to receive various objects. In addition, a knee indentation may be formed in the rear wall to extend to an elevation of a lecturer's knee. Similarly, a toe kick indentation may be formed in the rear wall near a bottom to receive a portion of the lecturer's foot.

In accordance with another aspect of the present invention, the front wall is curved to provide structural rigidity and prevent buckling or warping. The front wall may be convex or concave. In addition, the front wall may be curved from one side to the other, or from an upper end to a lower end.

Additional features and advantages of the invention will be set forth in the detailed description which follows, taken in conjunction with the accompanying drawing, which together illustrate by way of example, the features of the invention.

BRIEF DESCRIPTION OF THE DRAWINGS

FIG. 5*a* is a front view of another lectern in accordance with the present invention;

DETAILED DESCRIPTION

Figure 1:
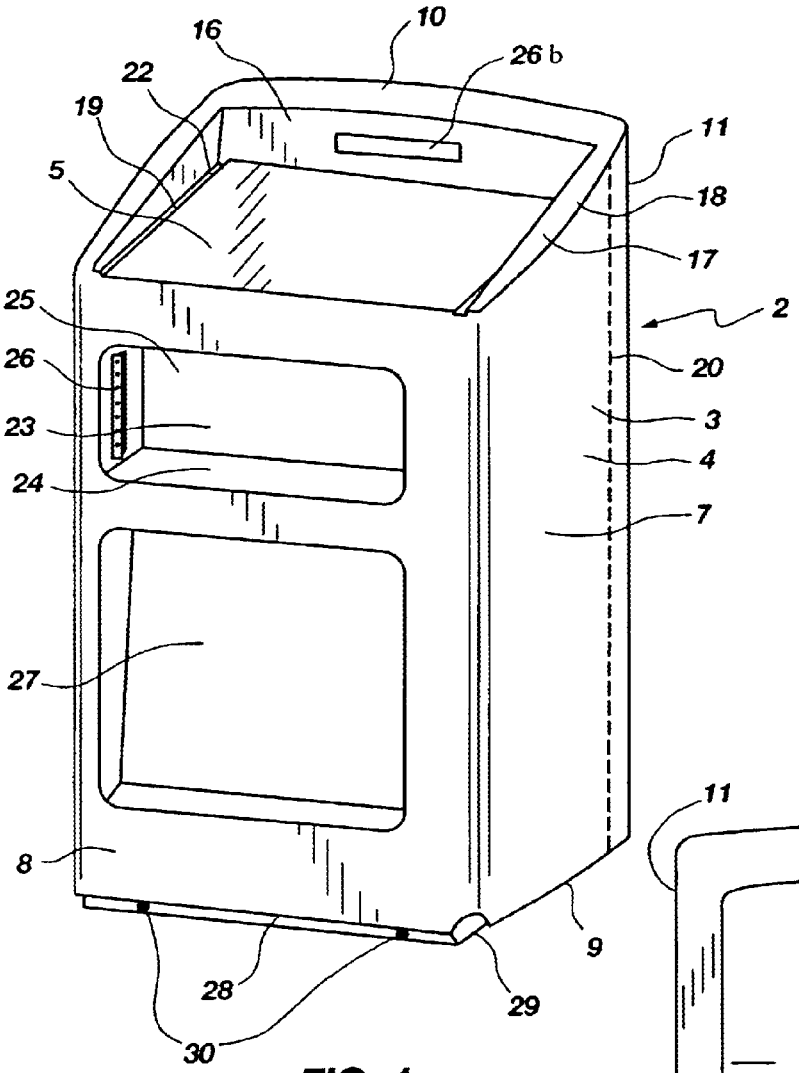
FIG. 1 is a perspective view of a lectern in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
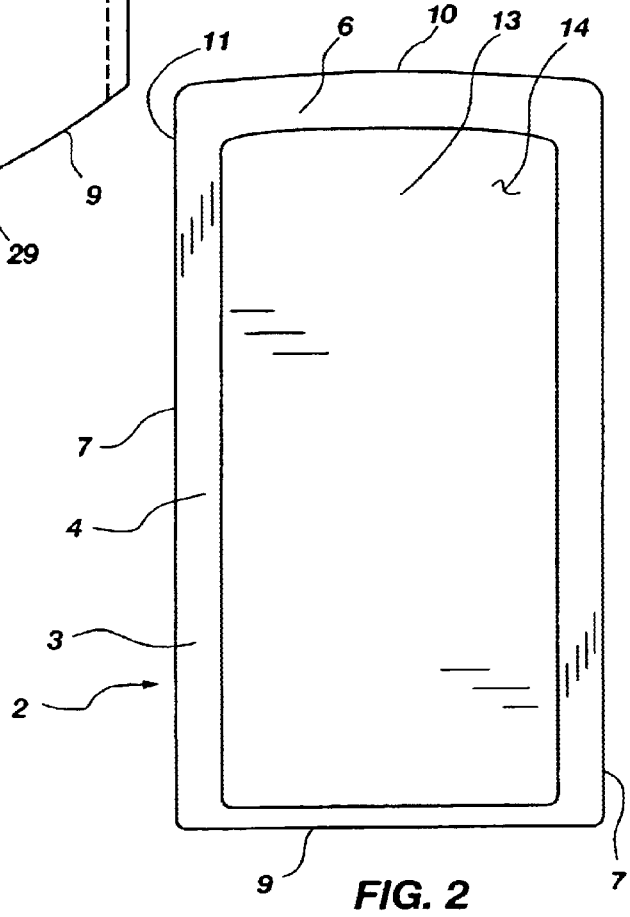
FIG. 2 is a front view of the lectern shown in FIG. 1.
Figure 3:
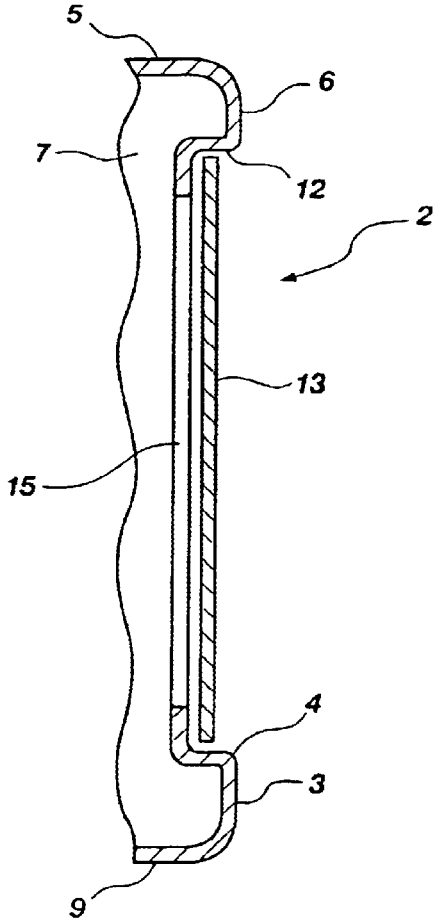
FIG. 3 is a partial cross sectional side view of the lectern of FIG. 1.
Figure 3B:
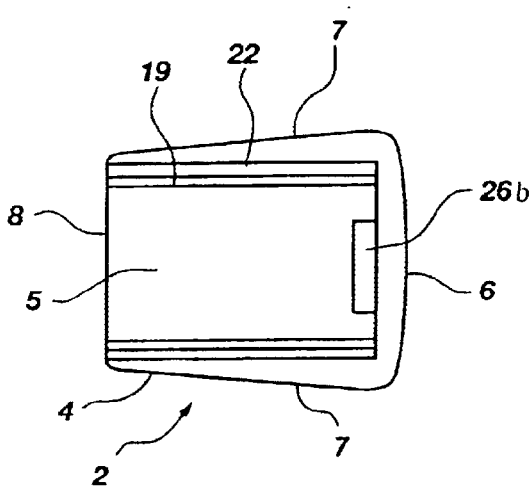
FIG. 3*b* is a top view of the lectern of FIG. 1.

As illustrated in FIGS. 1–3, a lectern, indicated generally at 2, in accordance with the present invention is shown. The term "lectern" is used broadly herein to refer to any type of lectern or podium, and the like. Various aspects of the lectern 2 are described in U.S. patent application Ser. No. 09/023,190, which is herein incorporated by reference.

The lectern 2 advantageously is formed of a single continuous shell, or unitary integrated shell 3. Thus, the shell 3 is a single unitary structure which is continuously and integrally formed. The shell 3 advantageously includes an integral exterior wall, or continuous wall 4. The integral and continuous wall 4 includes a top wall 5, a front wall 6, side walls 7, a rear wall 8, and a bottom wall 9, which collectively enclose a hollow interior cavity.

The top wall 5 has a support surface configured to support a lecturer's notes. The top wall 5 may be oriented at an angle facing generally upward and toward the lecturer. The front wall 6 is configured to face towards an audience. In addition, the front wall 6 preferably has a height sized to extend substantially from the floor to at least the top wall 5. The opposite side walls 7 also have a height sized to extend from the floor or support surface to at least the top wall 5. The rear wall 8 is configured to face the lecturer and also has a height sized to extend from the floor support surface to at least the top wall 5. Finally, the bottom wall 9 is configured to be disposed on the floor or support surface.

Thus, the continuous integral shell 3 and the integral continuous wall 4 are formed by the top wall 5, front wall 6, side walls 7, rear wall 8, and bottom wall 9, which are integrally formed together and extend continuously about the shell 3 or perimeter of the lectern 2. In addition, the walls 4 form a single unitary structure or shell 3 which is capable of supporting its own weight, in addition to any weight placed on the top wall 5. The continuous and integral nature of the wall 4 and shell 3 provide rigidity to the shell 3 and prevent attachments or joints which may be weakened by transportation of the lectern 2. The hollow interior cavity enclosed by the wall 4 advantageously reduces the weight of the lectern 2.

The shell 3 and/or walls 4 preferably are formed of a plastic material. The plastic material is lightweight and durable. In addition, the plastic material may be provided with a coloring. Thus, the coloring extending through the plastic material will help hide any scratches or dings in the walls 4. The single unitary shell 3, continuous integral walls 4, and plastic material of the lectern 2 advantageously allow the shell 3 and walls 4 to be produced by rotational molding or blow molding.

The top wall 5 includes a perimeter which includes an edge joining the top wall 5 to the front wall 6, side walls 7, and rear wall 8. The edge 10 preferably is rounded. Similarly, the front wall 6 includes a perimeter with an edge 11 which joins the front wall 6 to the side walls 7. Preferably, the edge 11 is rounded.

Figures 5, 6, 7:
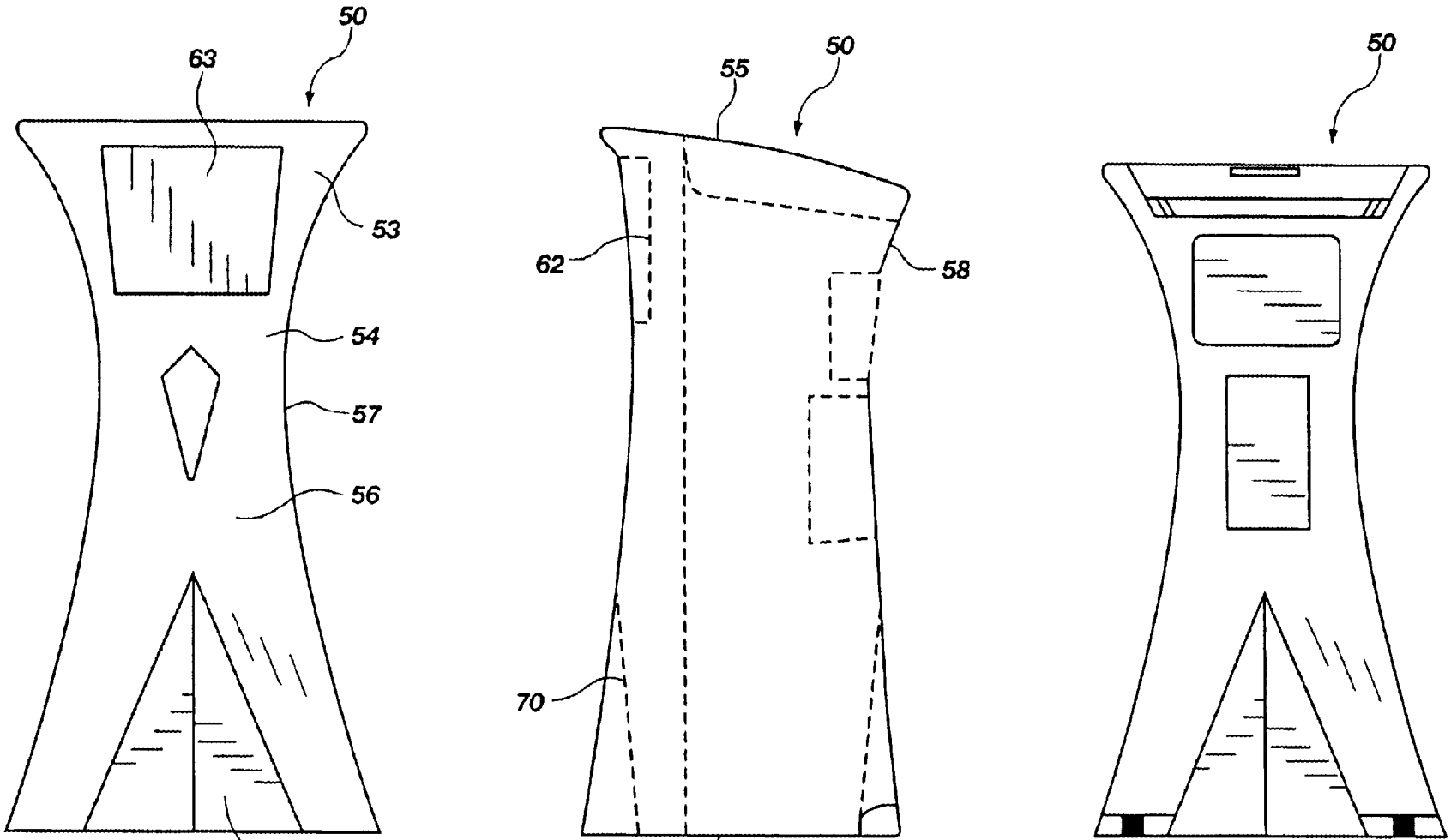
FIG. 6 is a side view of the lectern of FIG. 5.
FIG. 7 is a rear view of the lectern shown in FIG. 5.

As indicated above, the shell 3 is a lightweight structure. Thus, one or more of the walls 4 may be formed with a curvature to add strength to the walls 4 and prevent buckling or warping. Preferably, the front wall 6 is curved. As shown in FIG. 1, the front wall 6 may be convex, and curve from one side 7 to the opposite side 7. Alternatively, as shown in FIG. 6, the front wall may be convex and curve from an upper end to a lower end. In addition, the side walls 7 or rear wall 8 may also be formed with a similar curvature. In addition, the upper edge 10 and front edge 11 are curved or rounded to increase rigidity and prevent warping. In addition, the edges 10 and 11 are curved to prevent sharp corners which may cause damage to walls or other objects during transportation.

As stated above, the front wall 6 is configured to face the audience. Therefore, the front wall 6 preferably has an aesthetically pleasing surface. Referring to FIG. 3, a recess 12 preferably is formed in the front wall 6. A decorative insert 13 advantageously is disposed in the recess 12. The decorative insert 13 may have a forward facing surface 14, such as wood, etc., which is aesthetically pleasing and which may be chosen to match the decor of the facility in which the lectern 2 is used. The recess 12 advantageously covers the edges of the insert 13, such that the insert 13 may be a laminate or the like. In addition, the recess 12 advantageously helps prevent damage to the insert 13. The insert 13 may be attached to the front wall 6 or within the recess 12 in any appropriate manner, such as with screws, adhesive, hook and loop type fasteners and the like, etc. In addition, the insert 13 may be releasably secured within the recess 12, such that various different inserts may be used. For example, different inserts with different logos thereon may be interchanged to suit the particular situation. In addition, an opening 15 may be formed in the front wall 6 within the recess 12, and covered by the decorative insert 13. The opening 15 may remove a substantial material from the front wall to help reduce weight.

As stated above, the front of the lectern 2 or front wall 6, preferably is configured to be aesthetically pleasing as it faces the audience. Thus, the front wall 6 or front of the lectern 2 may be configured to be wider than the rest of the lectern 2. The side walls 7 may taper from a wider point near the front wall 6 to a more narrow portion at the rear wall 8. Thus, a parting line 20 for rotational molding may be located near the front of the lectern 2 or near the front wall 6. The wider front wall 6 helps to hide the parting line 20.

The wall 4 forming the shell 3 has a thickness. Preferably, the thickness of the walls 4 of the shell 3 is approximately ⅛-in.–⅜-in., and most preferably ¼-in. The thickness of the walls 4 or shell 3 preferably is substantially consistent throughout the shell 3.

Referring again to FIG. 1, a front shield 16 may extend above the top wall 5 at the front of the lectern 2 to block visual inspection of the lecturer's notes by the audience. The front shield 16 may be formed by a portion of the front wall 6 extending beyond the top wall 5. Similarly, the lectern 2 may have opposite side shields 17, also extending above the top wall 5 along the sides of the lectern 2, also to block visual inspection of the lecturer's notes by the audience. The opposite side shields 17 may be formed by the side walls 7 extending above the top wall 5. In addition, side holds, or opposite left and right grips 18, may be formed at the sides of the lectern on the top wall 5 for the lecturer to grip.

One or more ribs 19 may be integrally formed in the top wall 5 to help maintain the top wall in a flat configuration. In addition, the rib 19 may form an indentation 22 configured to hold a writing instrument or pointer.

The lectern 2 may also include an area for receiving various items such as audio visual equipment or electronics. Thus, the lectern 2 may include a recess 23 formed in the rear wall 8. The recess 23 may include side walls and a bottom.

A wall 24 may be formed around the circumference of the recess 23 extending inwardly and towards the interior cavity. An opening 25 may be formed in the bottom of the recess 23. The wall 24 provides support for the recess 23 and provides structure for mounting equipment within the recess 23. Thus, a rack rail 26 may be mounted to the wall 24 to allow mounting of various audio visual equipment or electronics.

A knee indentation 27 may also be formed in the rear wall 8. The knee indentation 27 may extend to an elevation near the lecturer's knee for receiving the lecturer's knee. In addition, a toe kick indentation 28 may also be formed in the rear and bottom walls 8 and 9 to receive a portion of the lecturer's foot.

The lectern 2 may be provided with other indentations or protrusions for providing various accessories. For example, a light visor **26*b* may be formed in the front shield 16 to receive a light for illuminating the lecturer's notes on the top surface 5. In addition, an indentation 29 may be formed near the bottom of the lectern 2** for receiving electrical connections.

Figure 4A:
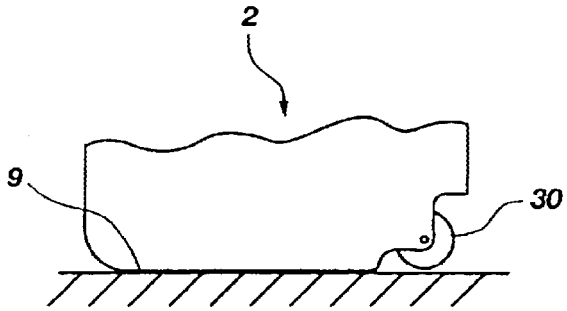
FIG. 4*a* is a partial side view of the lectern of FIG. 1 shown in a standing, usable position.
Figure 4B:
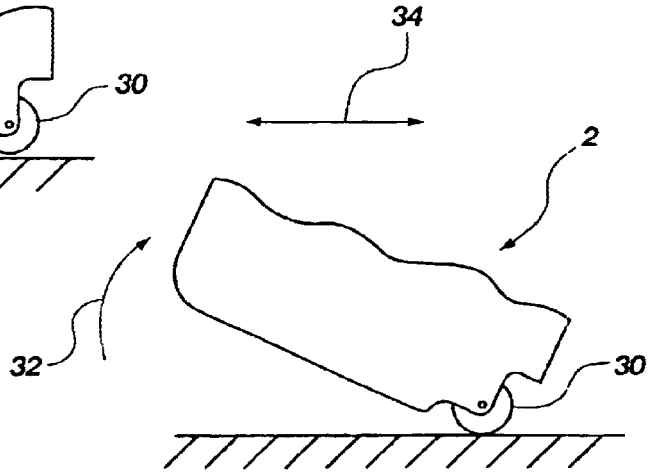
FIG. 4*b* is a partial side view of the lectern of FIG. 1 shown in a tilted transportable position.

Referring to FIGS. **4*a* and 4*b*, the bottom wall 9 of the lectern is configured to be disposed against the floor or support surface. In addition, the lectern 2 may be provided with one or more wheels 30 disposed near the bottom of the lectern 2, and preferably at the rear. Thus, the lectern 2 may be pivoted rearwardly, indicated by arrow 32 in FIG. 4*b*, to rest on the wheels 30 for transportation, indicated by arrow 34. Thus, both the bottom wall 9 and the wheels 30** are configured to touch the ground or support surface.

Referring to FIGS. 5–7, another lectern 50 in accordance with the present invention is shown, which is similar in many aspects to the lectern shown and described above. The lectern 50 includes a single unitary shell 53 formed by a continuous integral wall 54. The wall includes a front wall 56 which is concave and curves from an upper wall 55 to a bottom wall 59. In addition, the wall 54 includes opposite side walls 57 which also are concave. Similarly, the wall 54 includes a rear wall 58 which is also broadly concave. The concave walls 54 advantageously provide a structural rigidity to the walls, and thus the shell 53. Again, the lectern 50 may include a decorative insert 63 disposed in a recess 62.

The wall 54 of the lectern 50 may include other indentations and protrusions, such as indentation 70. Such indentations 70 may provide aesthetically pleasing geometry, as well as adding structural rigidity to the shell 53.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A floor standing lectern, comprising:

a plastic-molded shell having an integral, continuous exterior wall comprised of top, front, side, rear and bottom walls which collectively enclose a hollow interior cavity;

the top wall having a support surface configured to support a lecturer's notes and a perimeter which substantially comprises a rounded edge joining the top wall to the side, front and rear walls;

a front shield, extending upwardly from the top wall, configured to block visual inspection of the lecturer's notes by the audience;

the front wall being configured to face an audience and having a height sized to extend substantially from the floor to at least the top wall, the front wall having a perimeter which substantially comprises a rounded edge joining the front wall to the opposite side walls; the side and rear walls having a height sized to extend substantially from the floor to at least the top wall; and the front wall of the lectern being wider than the rear wall of the lectern, and having a mold parting line located along the side walls such that the parting line is hidden from view from a front of the lectern by the front wall.

2. A lectern in accordance with claim 1, wherein the exterior wall has a thickness between approximately ⅛ inch to ⅜ inch.

3. A lectern in accordance with claim 1, wherein the exterior wall has a thickness of approximately ¼ inch.

4. A lectern in accordance with claim 1, further comprising:

a recess, formed in the front wall; and a decorative insert, disposed within the recess.

5. A lectern in accordance with claim 4, further comprising an opening formed through the front wall at the recess and covered by the decorative insert to reduce weight of the lectern.

6. A lectern in accordance with claim 1, further comprising:

opposite side shields, formed by the side walls extending above the top wall, configured to block visual inspection of the lecturer's notes by the audience.

7. A lectern in accordance with claim 1, further comprising:

opposite left and right grips, formed at left and right sides by the top wall and the opposite side walls, configured to be griped by a lecturer while lecturing.

8. A lectern in accordance with claim 1, further comprising:

a rib, integrally formed in the top wall, configured to maintain the top wall in a flat configuration and forming an indentation configured to hold a writing instrument or pointer.

9. A lectern in accordance with claim 1, wherein the top wall is inclined and configured to face towards the lecturer.

10. A lectern in accordance with claim 1, further comprising:

a recess, formed in the rear wall, including sides and a bottom;

a wall, formed around a circumference of the recess and extending inwardly towards the interior cavity; and an opening, formed in the bottom of the recess.

11. A lectern in accordance with claim 1, further comprising:

a knee indentation, formed in the rear wall, configured to extend to an elevation of a lecturer's knee; and a toe kick indentation, formed in the rear wall near a bottom, configured to receive a portion of the lecturer's foot.

12. A lectern in accordance with claim 1, wherein the front wall is curved.

13. A lectern in accordance with claim 12, wherein the front wall is convex.

14. A lectern in accordance with claim 12, wherein the front wall is concave.

15. A lectern in accordance with claim 12, wherein the front wall is curved from one side to the other.

16. A lectern in accordance with claim 12, wherein the front wall is curved from an upper end to a lower end.

17. A lectern in accordance with claim 1, further comprising at least one tilt back wheel located such that both the at least one tilt back wheel and a bottom of the lectern rest on floor so that the lectern can be pivoted onto the at least one tilt back wheel.

18. A floor standing lectern, comprising:

a top wall having a top surface; a bottom wall; a front wall extending upwardly from the bottom wall and having a portion extending above said top wall; two side walls extending upwardly from said bottom wall each having a portion extending above said top wall; a back wall;

at least one receptacle provided in the front wall for receiving a decorative insert;

a tilt back wheel receiving area at the bottom of the back wall for receiving tilt back wheels for ease of transporting; and at least one recess or indentation provided near an outside bottom of the lectern for mounting of electronic connectors, said at least one recess or indentation having a depth such that an electronic connector being mounted thereon does not protrude beyond the wall.

19. A lectern, comprising:

a top wall having a top surface; a bottom wall; a front wall extending upwardly from the bottom wall and having a portion extending above said top wall; two side walls extending upwardly from said bottom wall each having a portion extending above said top wall; a back wall having an opening;

at least one receptacle provided in the front wall for receiving a decorative insert;

at least one recess or indentation provided near an outside bottom of the lectern for mounting of electronic connectors, said at least one recess or indentation having a depth such that an electronic connector being mounted thereon does not protrude beyond the wall; and rail means disposed near the opening for mounting electronic equipment.

* * * * *